US006024018A

United States Patent [19]

Darel et al.

[11] Patent Number: 6,024,018

[45] Date of Patent: Feb. 15, 2000

[54] ON PRESS COLOR CONTROL SYSTEM

[75] Inventors: Yair Darel; Miriam Nagler, both of Tel Aviv; Hanan Weisman, Ra'anana, all of Israel

[73] Assignee: Intex Israel Technologies Corp., Ltd, Tel Aviv, Israel

[21] Appl. No.: 08/834,762

[22] Filed: Apr. 3, 1997

[51] Int. Cl.[7] ..... B41F 31/00

[52] U.S. Cl. ..... 101/365; 101/484

[58] Field of Search ..... 101/365, 484; 395/109, 117

[56] References Cited

U.S. PATENT DOCUMENTS

| | | | |
|---|---|---|---|
| D. 357,695 | 4/1995 | Ott | D16/238 |
| 4,369,706 | 1/1983 | Forster et al. | 101/365 |
| 4,390,958 | 6/1983 | Mamberer | 364/550 |
| 4,649,502 | 3/1987 | Keller et al. | 364/519 |
| 4,655,135 | 4/1987 | Brovman | 101/426 |
| 4,718,768 | 1/1988 | Houki et al. | 356/402 |
| 4,787,060 | 11/1988 | Weisgerber et al. | 101/426 |
| 4,813,000 | 3/1989 | Wyman et al. | 364/526 |
| 4,834,541 | 5/1989 | Yamaba | 356/406 |
| 4,841,140 | 6/1989 | Sullivan et al. | 250/226 |
| 4,881,181 | 11/1989 | Jeschke et al. | 365/101 |
| 4,954,972 | 9/1990 | Sullivan | 364/526 |
| 5,010,820 | 4/1991 | Loffler | 101/365 |
| 5,170,711 | 12/1992 | Maier et al. | 101/365 |
| 5,175,426 | 12/1992 | Chuan-yu | 250/208.1 |
| 5,223,916 | 6/1993 | Muraoka | 356/402 |
| 5,224,421 | 7/1993 | Doherty | 101/211 |
| 5,381,209 | 1/1995 | Binder et al. | 355/27 |
| 5,426,508 | 6/1995 | Schrammli | 356/402 |
| 5,444,513 | 8/1995 | Staheli et al. | 355/27 |
| 5,519,210 | 5/1996 | Berner | 250/226 |
| 5,523,879 | 6/1996 | Ota | 359/333 |
| 5,524,542 | 6/1996 | Toyama | 101/483 |
| 5,526,998 | 6/1996 | Ackermann et al. | 242/532.7 |
| 5,530,563 | 6/1996 | Zimmermann et al. | 358/517 |
| 5,530,656 | 6/1996 | Six | 364/526 |
| 5,551,342 | 9/1996 | Fuchs et al. | 101/484 |

FOREIGN PATENT DOCUMENTS

| | | | |
|---|---|---|---|
| 0658428 | 6/1995 | European Pat. Off. | 101/365 |

*Primary Examiner*—John Hilten
*Attorney, Agent, or Firm*—Darby & Darby

[57] ABSTRACT

A color control system for maintaining the color of a printed page of a printing press constant, within the context of the human perceptual color space system optimizes the settings of a plurality of ink keys in a printing press in accordance with a test image and a reference image. The test and reference images comprise a plurality of ink key zones corresponding to the plurality of ink keys, each ink key zone including a plurality of regions of interest (ROIs). The system includes a unit for imaging an area of the printed page in generating the reference and test images, a unit for extracting color information based on actual image colors from the test image, a unit for measuring color deviations with reference to the reference image, and a unit for analyzing and comparing global features of regions of interest (ROIs) that cover substantially the color gamut of the test image against like features of the reference image. The analysis and comparison is based on a plurality of ROIs, all located within the same ink key zone, and the analysis and comparing unit operates to generate a set of CMYK changes to be applied to the plurality of ink keys. The system also includes a unit for applying the set of CMYK changes to the plurality of ink keys.

18 Claims, 11 Drawing Sheets

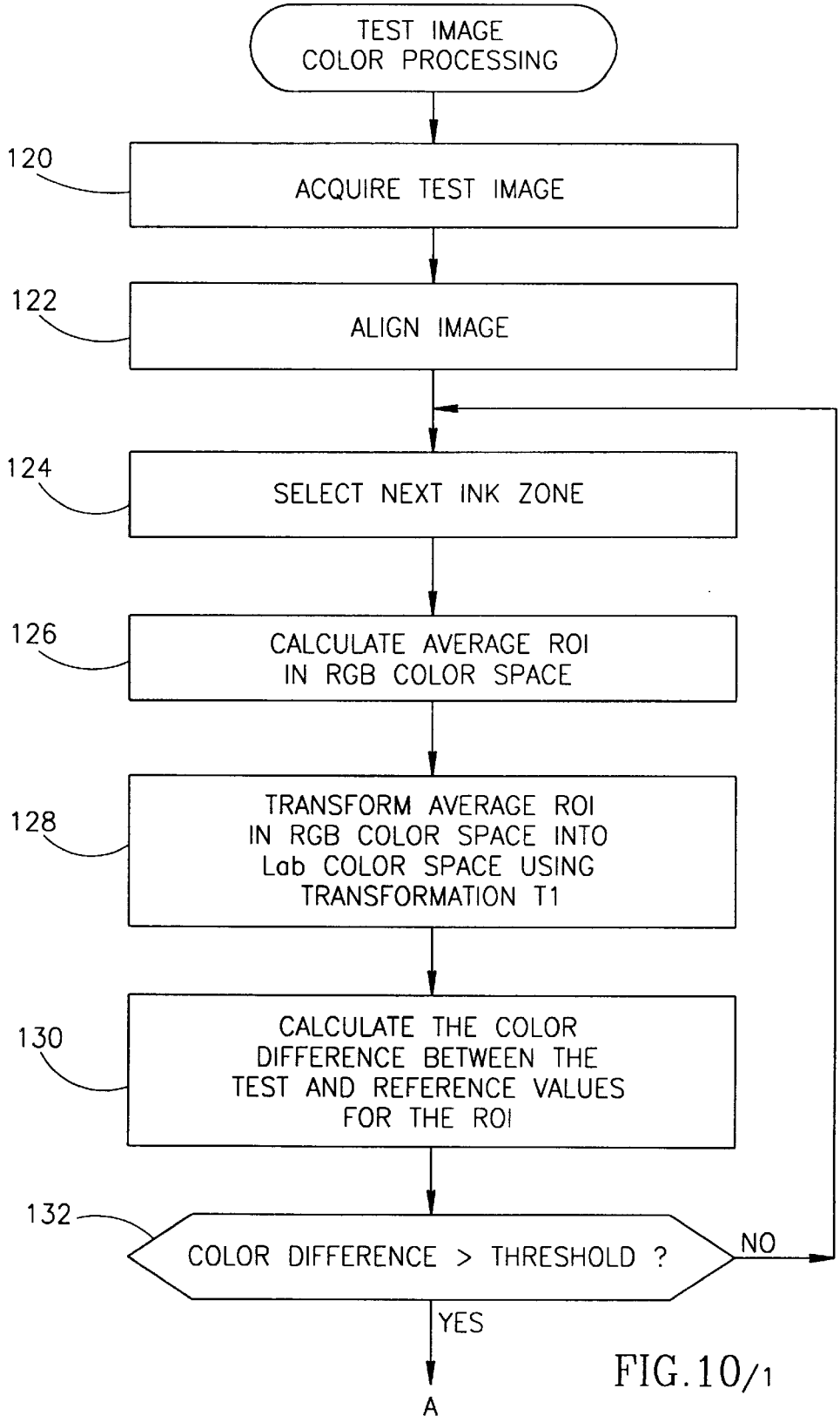
FIG.10/1

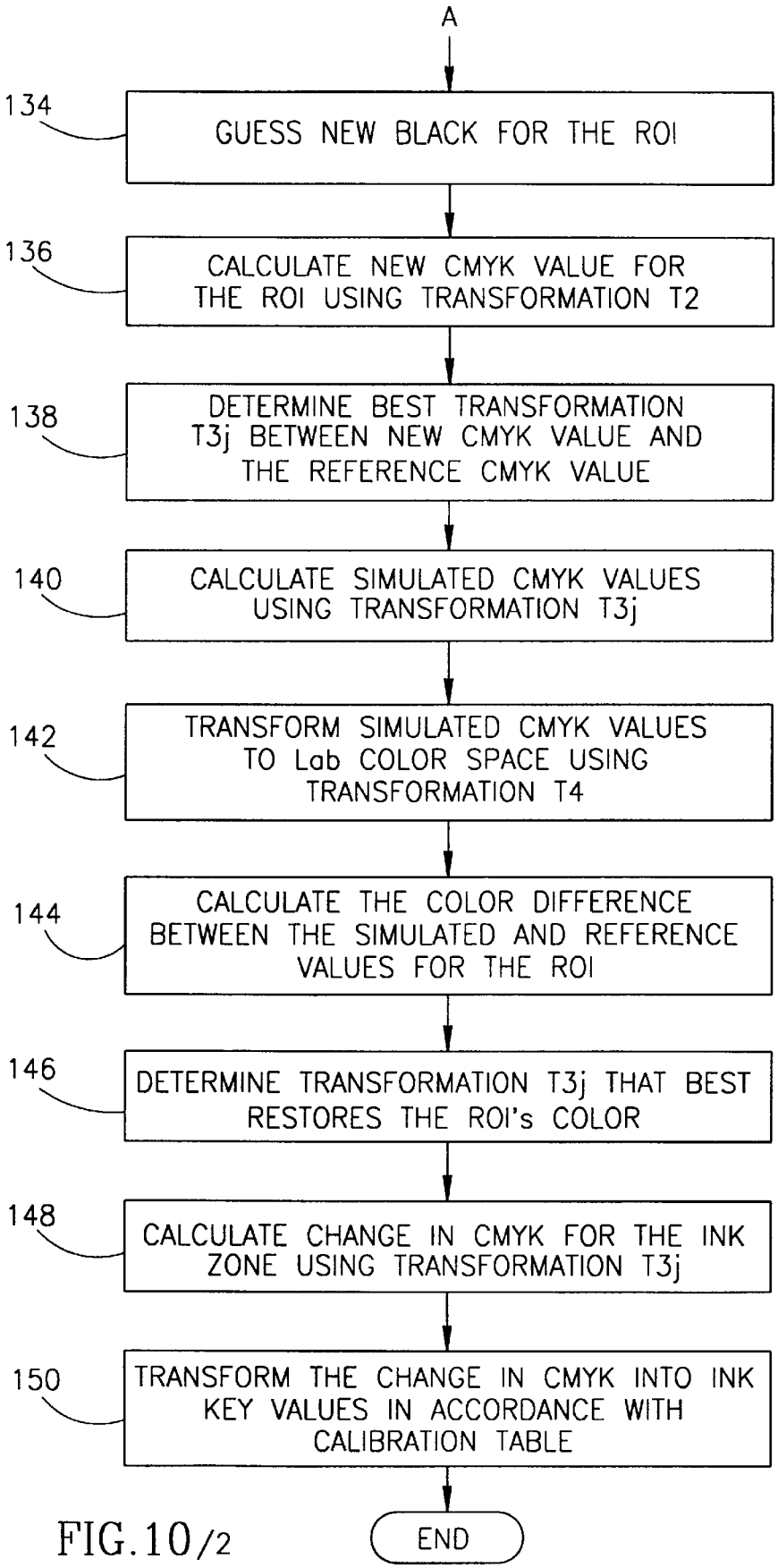
FIG.10/2

ON PRESS COLOR CONTROL SYSTEM

FIELD OF THE INVENTION

The present invention relates to color printing press systems and more specifically to a system for monitoring and controlling color deviations during the startup and regular running phase of the printing process.

BACKGROUND OF THE INVENTION

Offset printing press system are typically subject to many variations and defects caused by changes in ink rheology, ink-water balance, temperature, etc. These variations and defects cause continuous changes in the colors within the print during the printing process. In light of the current trend of reduced print order size coupled with increased quality demands of customers, a highly skilled pressman is needed to run the press.

Critical control is required, for example, in the setting of each of the ink keys on an offset printing press. Each ink key is adjusted both before and during the printing process so as to properly meter the amount of ink that flows onto the printing plate. In older manually operated presses, a pressman visually scans the printing plate and estimates the amount of ink needed within each of the sections controlled by the ink keys. In other systems, an optical scanner is used to scan a printing plate to determine the amount of ink needed. This information is then processed to automatically set the ink keys.

More modern presses use electromechanical means to set the ink keys remotely and to sense the actual position of the ink key actuators. The ink key data is displayed at a control table used by the pressman to effect control over each ink key. Typically, the ink keys are preset either in accordance with the pressman's judgment or by automatic means. Once the initial adjustments are made, the press is started. Further adjustments are made to the ink keys to compensate for registration of various colors, water fountains, etc. in order to improve the quality of the output until acceptable quality is achieved. As the press continues to run, further fine adjustments are made by the pressman until, usually after several hours of running, high grade printing, i.e., 'OK printing,' is achieved.

The disadvantage of this system is that adjustments to the ink keys during the running of the press must be made manually by the pressman. Although, the ink keys may be remotely actuated via a control table, the adjustments are still determined by the pressman's subjective judgment.

Thus, it is desirable to have a color measurement system capable of automatic color evaluation and control similar to that performed by a skilled pressman. Such a system would help to both maintain high printing standards and to reduce printing costs.

SUMMARY OF THE INVENTION

Accordingly, the present invention provides a color quality control system for monitoring deviations in color during the startup and continuous running phases of printing. The color control system is intended to enable the generation of print product having constant color even during long press runs while empowering the press operator with the ability to control the correction process. Further, the color control system should improve the productivity of the entire printing unit by reducing paper waste during the startup and continuous running phases of printing and by reducing costs by reducing print preparation time and needed manpower while achieving increased product quality.

The color control system comprises an image acquisition, image processing unit, control unit and a console unit. The image acquisition unit is situated directly on the press machine itself, at the end of the printing process, and functions to acquire images directly off the printed output of the press. The system functions to perform on the fly color measurements from the image acquired by the image acquisition unit and uses these measurements to generate corrections in a closed loop manner whenever deviations are detected. Color deviations are detected relative to a known reference which is acquired prior to the continuous running of the press, i.e., at the end of the make ready process. Correction to the color is effected by controlling the ink and water keys in offset presses and by controlling various print controls in digital presses. The color control system has applications to offset web and sheet fed presses, gravure presses and to digital presses as well.

There is therefore provided in accordance with the present invention a color control system for maintaining the color of a printed page of a printing press constant, within the context of the human perceptual color space, the system optimizing the settings of a plurality of ink keys in a printing press in accordance with a test image and a reference image, the test image and the reference image comprising a plurality of ink key zones corresponding to the plurality of ink keys, each ink key zone comprising a plurality of regions of interest (ROIs), the system comprising means for imaging an area of the printed page in generating the reference image and the test image, means for extracting color information based on actual image colors from the test image, means for measuring color deviations with reference to the reference image, means for analyzing and comparing global features of regions of interest (ROIs) that cover substantially the color gamut of the test image against like features of the reference image, the analysis and comparison based on a plurality of ROIs, all located within the same ink key zone, the analysis and comparing means operative to generate a set of CMYK changes to be applied to the plurality of ink keys, and means for applying the set of CMYK changes to the plurality of ink keys.

There is also provided in accordance with the present invention a method of maintaining the color of a printed page of a printing press constant within the context of the human perceptual color space with respect to a reference image, the printed page including a plurality of ink key zones, the method comprising the steps of generating a test image based on the entire area of the printed page, extracting information for analysis from inside the test image, generating a plurality of regions of interest (ROIs) within each ink key zone from the extracted information, applying a weight to each ROI, and analyzing information from all ROIs within each ink zone, utilizing the weights.

Further, there is provided in accordance with the present invention a method for analyzing a plurality of regions of interest (ROIs) so as to resolve the ambiguity in the transformation from RGB information acquired by the imaging means to CMYK values, the method comprising the step of choosing a CMYK value for each ink key zone such that the sum of color deviations following the ink key changes for all ROIs is minimized with respect to the reference image in the Lab color space.

There is also provided in accordance with the present invention a method for maintaining the color of a printed page of a printing press constant, within the context of the human perceptual color space, the method optimizing the settings of a plurality of ink keys in a printing press in accordance with a test image and a reference image, the test image and the reference image comprising a plurality of ink key zones, each ink key zone comprising a plurality of regions of interest (ROIs), the method comprising the steps of generating the reference image and the test image by imaging an area of the printed page, extracting color information based on actual image colors from the test image, measuring color deviations with reference to the reference image, generating a set of CMYK values, one for each ink key zone, such that the sum of color deviations following ink key changes for all ROIs, relative to the reference image, is minimized in the Lab color space, and applying the set of CMYK changes to the plurality of ink keys.

There is also provided in accordance with the present invention, in a color control system for maintaining optimal settings for a plurality of ink keys in a printing press in accordance with a reference image, a method for processing the reference image, the method comprising the steps of pre-processing the reference image to reduce noise therein, selecting registration patterns within the reference image, performing a color transformation on the reference image, performing image segmentation on the reference image to yield a plurality of regions of interest (ROIs), and generating reference image data comprising the plurality of ROIs.

The step of performing image segmentation comprises the steps of selecting an initial trial cluster, applying a K-mean clustering algorithm iteratively whereby the number of clusters increases until all the pixels making up the reference image are classified, perform spatial clustering whereby proximate pixels belonging to the same cluster are grouped into preliminary regions of interest (ROIs), and extracting final ROIs from the preliminary ROIs, the final ROIs cover the entire print gamut and are distributed over the entire reference image.

There is further provided in accordance with the present invention, in a color control system for maintaining optimal settings for a plurality of ink keys in a printing press in accordance with a test image and a reference image, the test image and the reference image comprising a plurality of regions of interest (ROIs), a method for processing the test image, the method comprising the steps of dividing the test image into a plurality of ink zones, calculating the average RGB of each ROI in the ink zone, transforming the average RGB of each ROI into the Lab color space, calculating the color difference $\Delta E$ between the test and reference ROIs, comparing the color difference of each ROI to a predetermined threshold whereby the ink zone is not affected if the color difference is below the threshold and processing continues with the next ink zone in the plurality of ink zones, selecting a new black value for each ROI in the ink zone, calculating a simulated CMYK value for the ROI, determining a first optimum transformation between the new CMYK value and a CMYK value of the reference image, transforming the simulated CMYK values to the Lab color space, calculating the color difference between the simulated and the reference values for the ROI, determining a second optimum transformation that best restores the color of the ROI to that of the ROI within the reference image, and calculating the change in CMYK for the ink zone utilizing the second optimum transformation.

There is also provided in accordance with the present invention, in a color control system for maintaining optimal settings for a plurality of ink keys in a printing press in accordance with a test image and a reference image, the test image and the reference image comprising a plurality of ink zones corresponding to the plurality of ink keys, each ink zone comprising a plurality of regions of interest (ROIs), a method for processing the test image, the method comprising the steps of analyzing the plurality of regions of interest (ROIs) within the ink zone based on information extracted from within the test image, choosing one CMYK change for the ink zone such that the sum of all color deviations, for the plurality of ROIs, following adjustment of the ink key corresponding to the ink zone, is minimized with respect to the reference image.

There is also provided in accordance with the present invention a color control system for maintaining for a plurality of ink keys in a printing press in accordance with a reference image, the system comprising an image acquisition unit for acquiring a test image of a print printed on the printing press, an image processing unit coupled to the image acquisition unit, the image processing unit for analyzing the test image with respect to the reference image, the image processing unit for generating at least one color correction suggestion for use in adjusting the plurality of ink keys, a control unit coupled to the image processing unit, the control unit for controlling the plurality of ink keys on the printing press in accordance with the at least one suggestion, and a console unit coupled to the image acquisition unit, the image processing unit and the control unit, the console unit for providing, through a user interface, control over the system, status information and information about the color quality of the printing process.

The image processing unit comprises a processor for controlling the image processing unit and for executing analysis procedures on the reference and the test images, a frame grabber for receiving image data from the image acquisition unit, the frame grabber for generating and transmitting to the processor a digital representation of the imaging strip, a memory storage unit coupled to the processor, the memory unit for storing print images, and a control unit interface coupled to the processor, the control unit interface for providing an interface between the image processing unit and the control unit.

BRIEF DESCRIPTION OF THE DRAWINGS

The invention is herein described, by way of example only, with reference to the accompanying drawings, wherein:

FIG. 10, comprising FIG. 10/1 and FIG. 10/2, is a high level flow diagram illustrating the test image processing portion of the present invention.

DETAILED DESCRIPTION OF THE INVENTION

Notation Used Throughout

The following notation is used throughout this document

| Term | Definition |
|---|---|
| AF | Aperture Fluorescent |
| CCD | Charge Coupled Device |
| CMYK | Cyan, Magenta, Yellow, Black |
| CRP | Color Reference Patch |
| Lab | Perceptual Color Space |
| PMS | Pantone Matching System |
| RGB | Red, Green, Blue |
| ROI | Region of Interest |
| TDI | Time Delay and Integration |

General Description

Figure 1:
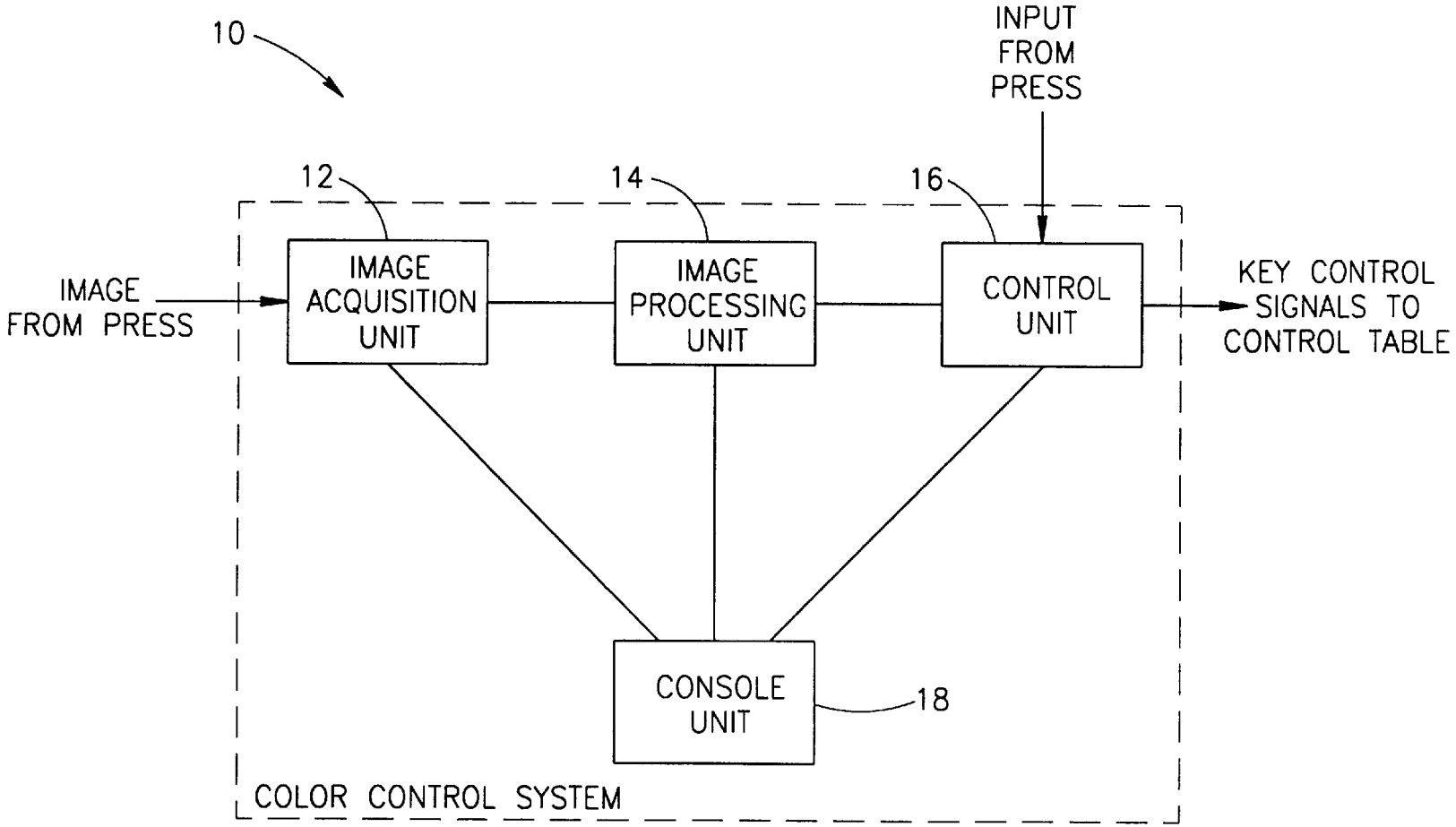
FIG. 1 is a high level block diagram illustrating the color control system of the present invention.

A high level block diagram illustrating the color control system of the present invention is shown in FIG. 1. The color control system, generally referenced 10, comprises an image acquisition unit 12, image processing unit 14, control unit 16 and a console unit 18. In implementing the color control system 10, each unit operated substantially independently of each other with all units communicating with each other via a dedicated communication network such as a local area network (LAN). Each subsystem is described in more detail below beginning with the image acquisition unit.

The system is a closed loop on the fly color control system for offset web and sheet fed presses, gravure presses and digital presses using four process colors, high fidelity spot colors and Pantone matching system (PMS) colors. Alternatively, the system can operate in an open loop fashion as well. The system functions to perform on the fly color measurements from within the image via the image acquisition unit. The system uses these measurements to generate corrections in a closed loop manner whenever deviations are detected. Color deviations are detected relative to a known reference which is acquired prior to the continuous running of the press. The reference image used can be either the OK sheet, the pre-press digital data or the proof Correction to the color is effected by controlling the ink and water keys in offset presses and by controlling various print controls in digital presses.

Image Acquisition Unit

The system 10 functions to image and analyze the compete printed area. This is in direct contrast to prior art system which only image and analyze a portion of the printed area such as color bars added to the print. The information that is analyzed is extracted from within the image. The system does not require color bars for analysis. However, color measurement and analysis may be performed on areas inside the printed image and dedicated areas outside the printed image, i.e., color bars.

Figure 2:
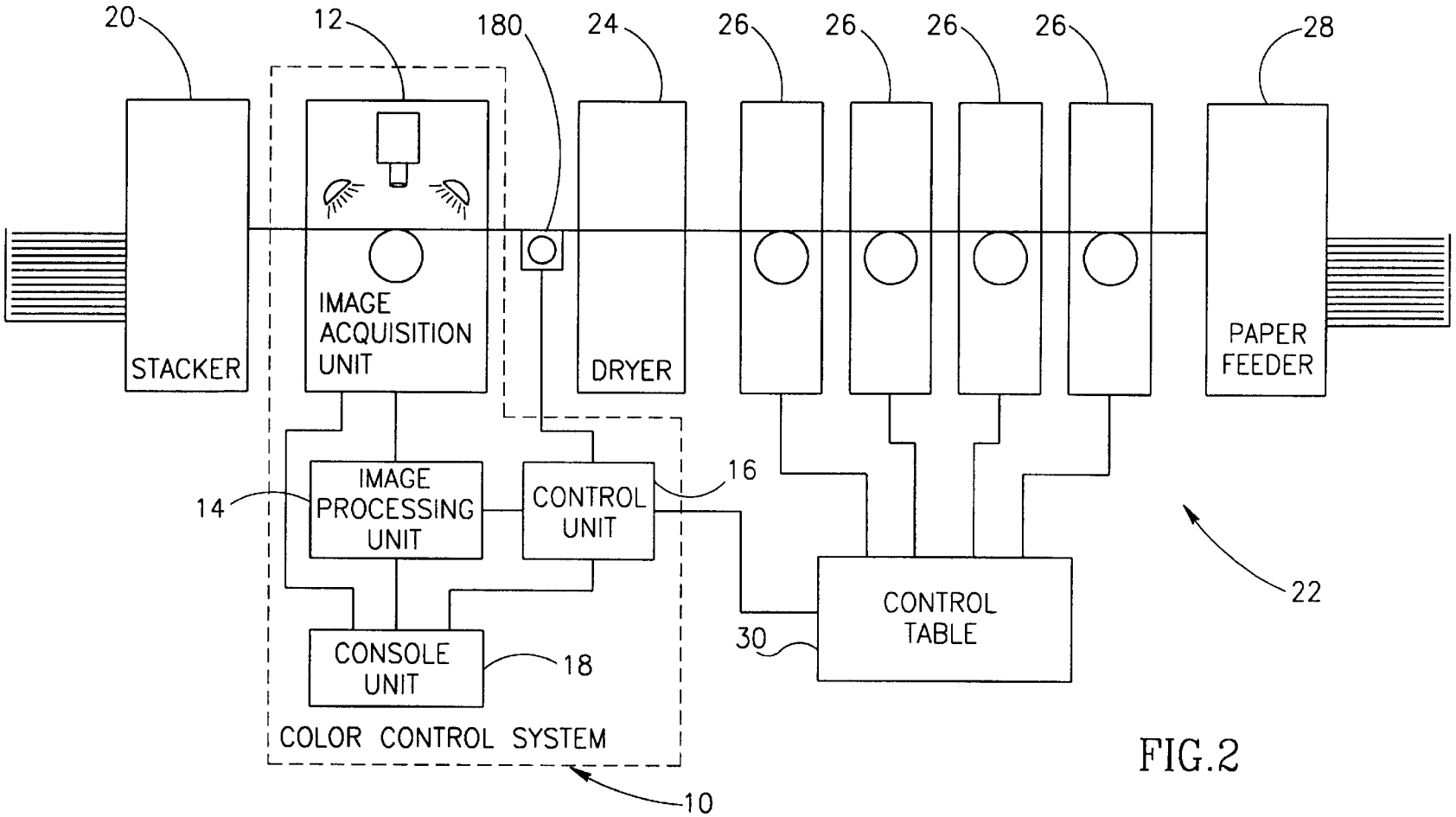
FIG. 2 is a high level block diagram illustrating the color control system of the present invention integrated into a web offset printing press.

A high level block diagram illustrating the image acquisition unit of the present invention integrated into a web offset printing press is shown in FIG. 2. As described previously, color measurements of the printed output are taken at the end of the printing process. Shown in FIG. 2 is a typical offset sheet fed press 22. The press comprises a paper sheet feeder 28, four color presses 26 representing, for example, cyan, magenta, yellow, black (CMYK), a dryer 24 and a stacker 20. The image acquisition unit 12 is placed after the dryer but before the prints are stacked. Each of the color presses is shown connected to a control table 30. The pressman both monitors and controls the ink keys within each of the presses 26. Also shown are the image processing unit 14, control unit 16 and console unit 18 of the color control system 10. In addition, the shaft encoder 180 is utilized in synchronizing the web to the acquisition of images.

Figure 3:
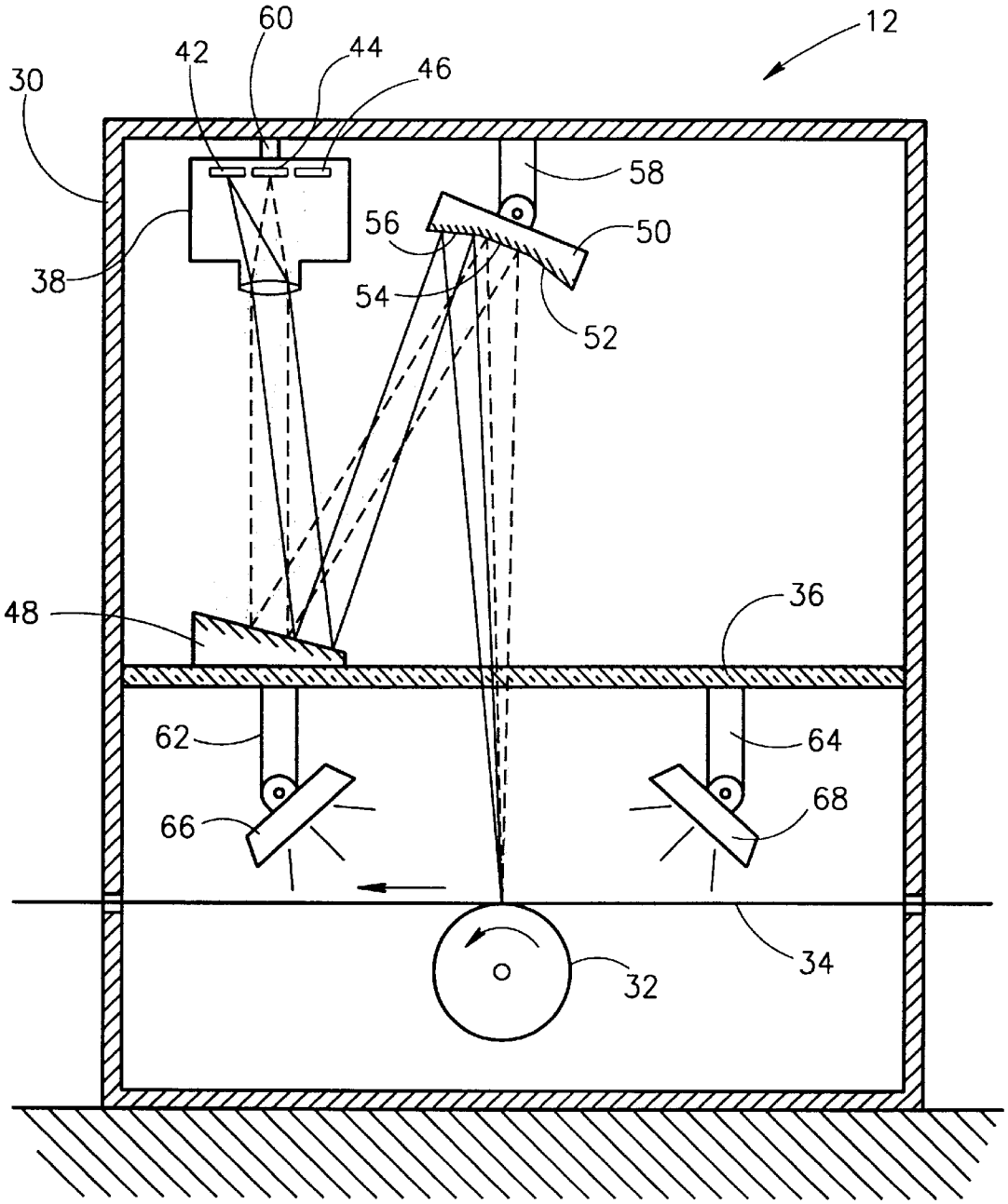
FIG. 3 is a side sectional view schematic diagram illustrating the optical and illumination portion of the image acquisition unit.

A side sectional view schematic diagram illustrating the optical and illumination portion of the image acquisition unit 12 is shown in FIG. 3. The image acquisition unit comprises an illumination portion, an imaging portion and an image capture portion. The image acquisition unit functions as a very fast image scanner. Without limiting the scope of the present invention, one possible technique for image sensing is based on charge coupled device (CCD) technology. In prior art high speed CCD based imaging systems, illumination energy is typically a problem. The image acquisition unit of the present invention utilizes relatively a fast and sensitive standard linear CCD sensor that is readily available from manufacturers such as Dalsa, Waterloo, Canada or Sony Corp. In addition, the illumination source for the CCD sensor produces high brightness and compensates for the sensors'spectral characteristics.

Figure 5:
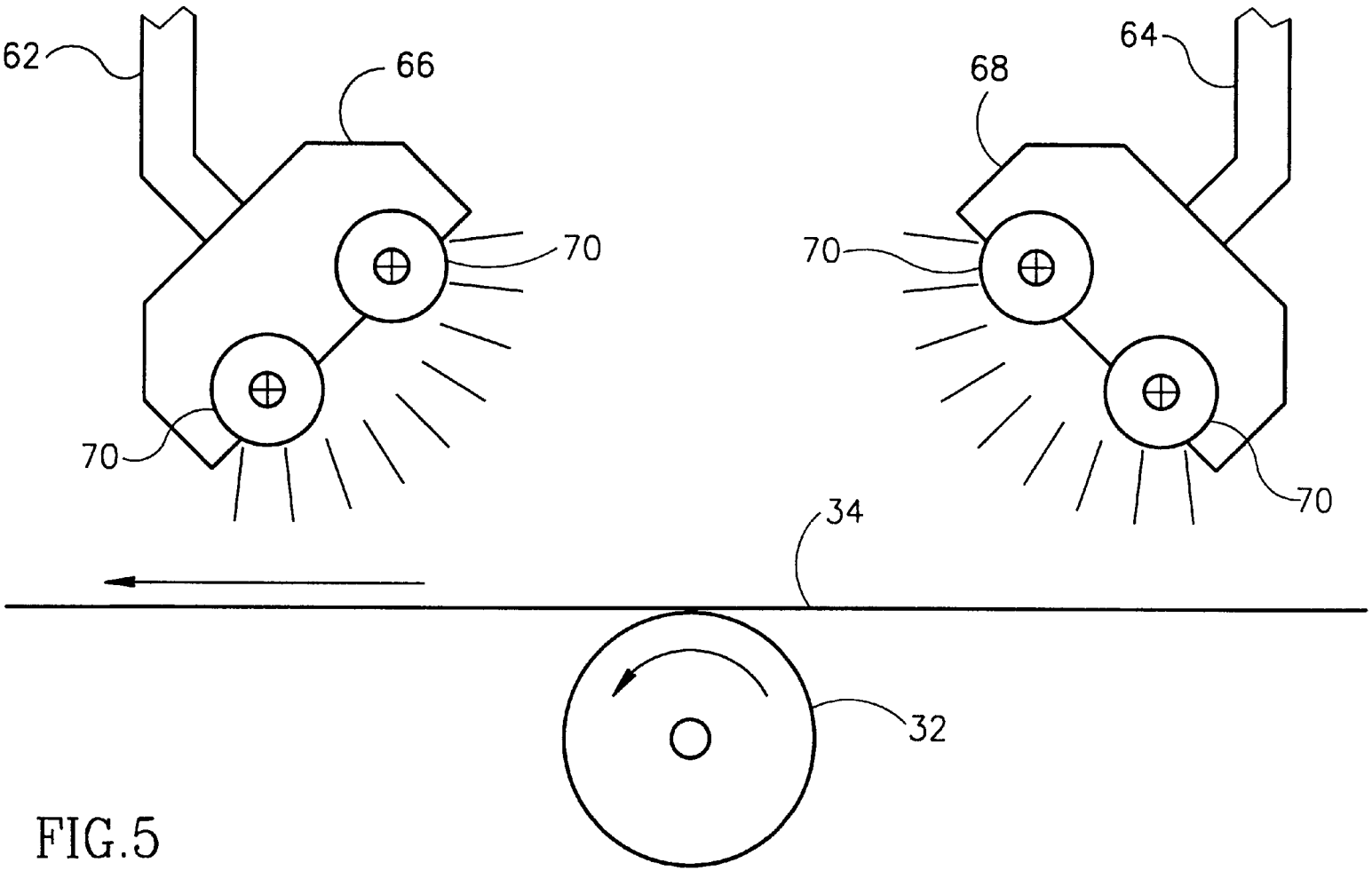
FIG. 5 is a side sectional view schematic diagram illustrating the illumination portion of the image acquisition unit in more detail.

The illumination portion of the image acquisition unit comprises lamps 66, 68 attached to a support member 36 via mounting brackets 62, 64, respectively. A side sectional view of the web is illustrated via drum or cylinder 32 and web printing surface 34. A side sectional view schematic diagram illustrating the illumination portion of the image acquisition unit in more detail is shown in FIG. 5. The lamps 66, 68 are shown each having two lamp elements 70 each. Each lamp element 70 is an elongated fluorescent lamp that homogeneously illuminates a strip of the print. In order to achieve very high lamp illumination intensity aperture fluorescent (AF) lamps can be used. Alternative means of illumination such as quartz lamps and regular fluorescent lamps can be used as well. In addition, reflectors may be used to increase the illumination and increase homogeneity. Further, the lamps are kept at a constant temperature in order to achieve high efficiency and a constant illumination over time.

With reference to FIG. 3, the image acquisition unit comprises a structural frame 30, an upper mirror 50, a lower mirror 48 and a video camera 38. The upper mirror is attached to the frame element 30 via support 58. The lower mirror 48 is attached to frame member 36. The video camera 38 is attached to frame element 30 via bracket 60. The upper mirror 50 actually comprises three separate mirrors 52, 54, 56 which are dedicated to reflecting light from red, blue, green portions of the print, respectively. The video camera 38 comprises three sensors 42, 44, 46 each imaging the red, blue, green portions of light from the print, respectively.

The image acquisition unit functions to capture an image of the entire print 34. Depending on the print's width a plurality of image acquisition units may be used in the system. A plurality of imaging units may be used in the system which would permit the imaging of large print sizes. As shown in FIG. 3, the resulting long optical path, which is needed to maintain a reasonable imaging angle, is folded in order to reduce the system's overall dimensions.

The video camera 38 comprises tri-linear color sensors, with each spectral channel receiving light from the same area or imaging strip on the web. The imaging strip must be illuminated homogeneously by the illumination source. To achieve homogeneous illumination, three tilted mirrors 52, 54, 56 are utilized as shown in the Figure. These three tilted mirrors are placed in the optical path such that the three spectral channels see exactly the same imaging strip. As mentioned previously, the three mirrors form part of the folding mirror system which is aimed to reduce the overall physical dimensions of the image acquisition unit.

The CCD sensor utilized in the example system presented here is a Tri-linear color time delay and integration (TDI) sensor, such as model CL-T3-2048A manufactured by Dalsa, Waterloo, Canada. Other sensors such as three single chip color or black and white sensors can be used as well. The tri-linear TDI sensor comprises three color stage selectable units which enable control over the camera's sensitivity and color balance. The TDI sensor provides a substantially higher sensitivity as compared to regular CCD sensors, thus permitting imaging at very high press speeds. The print 34 is scanned by the sensor as it moves through the image acquisition unit. Alignment between the sensor and the web and its synchronization to the press are critical for proper operation of the system. The TDI sensor and the web are kept synchronized by the use of a shaft encoder 180 (FIG. 2) affixed to the web. In addition, the image acquisition unit provides full control of acquisition parameters in real time during the running of the system. This enables the acquisition of the image to be invariant to illumination changes and to press speed. Some of the acquisition parameters include the number of stages in the TDI, i.e., the number of lines in the CCD, communication line rate and aperture of the camera.

In operation, the three separate red, blue, green components of the image are reflected by the three separate mirrors 52, 54, 56 onto lower mirror 48 and finally reach the video camera 38. The lens 40 images the three separate color components onto sensors 42, 44, 46. The three separate image components are represented in the Figure as solid, dashed, and dotted lines.

An advantage of using three linear TDI sensors, one sensor for each spectral channel, is that a very wide strip on the web can be imaged without sacrificing resolution. The use of the three tilted mirrors results in only one illumination strip being required rather than three as in prior art systems. Another benefit of using three tilted mirrors is that the illumination light can be concentration into a area one third the size since all three sensors see the same image strip. Thus less light is required reducing the cost of the system. In addition, the acquisition time can be shortened without reducing the signal to noise ratio of the system since all the illuminated light is concentrated into one strip. The single imaging strip can thus be more easily illuminated, obviating the need to slow the press. This allows the imaging of very fast moving webs.

Figure 4:
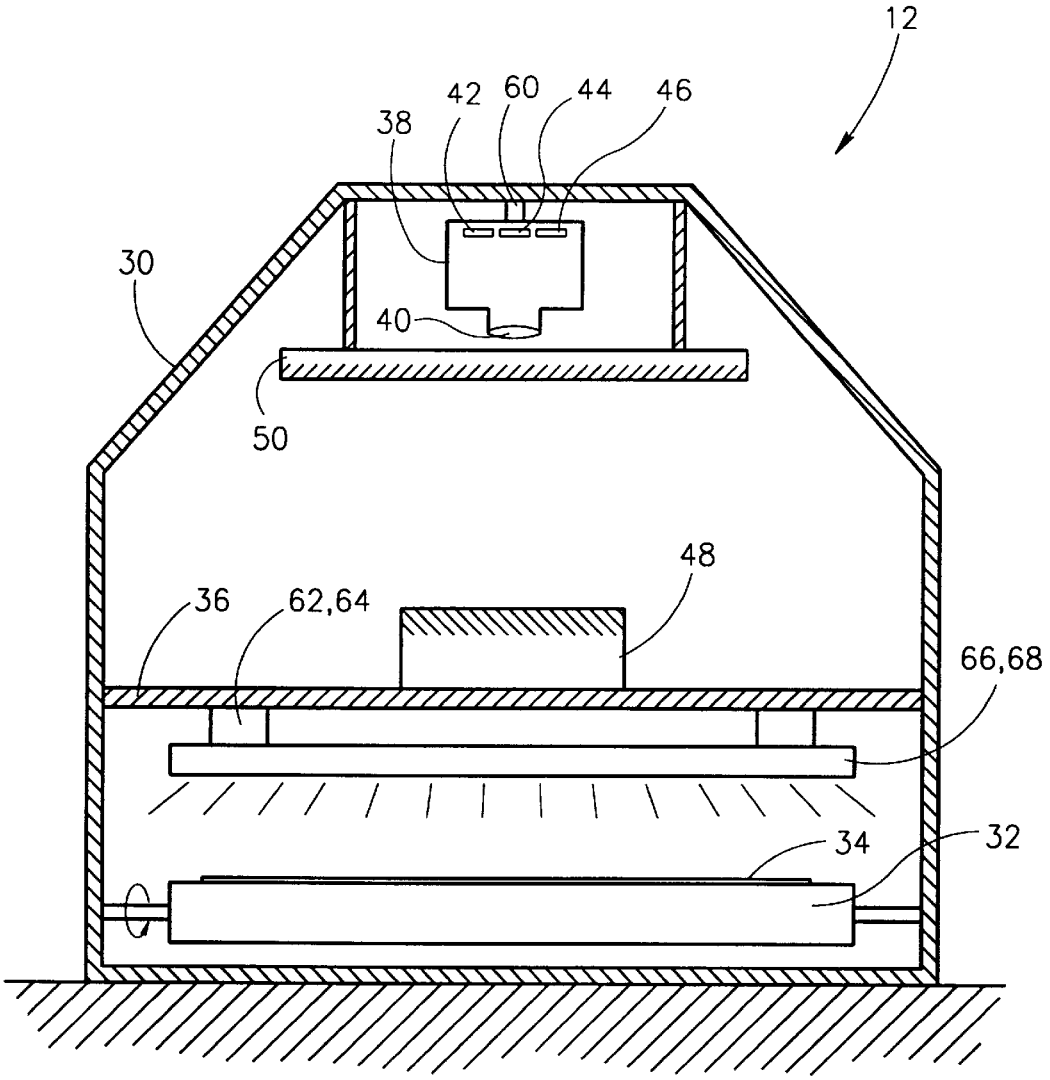
FIG. 4 is a cross sectional view schematic diagram illustrating the optical and illumination portion of the image acquisition unit.

A cross-sectional view schematic diagram illustrating the optical and illumination portion of the image acquisition unit is shown in FIG. 4. The image acquisition unit 12 is shown comprising a frame 30 and a cross support member 36. The illumination portion comprises lamps 66, 68 and supports 62, 64. Light from the lamps illuminate the print 34 which is driven by roller 32. The image from the print is reflected off of upper mirror 50 onto lower mirror 48 and is imaged onto sensors 42, 44, 46 through lens 40 in video camera 38. The camera is attached to the frame 30 via bracket 60.

Image Processing Unit

Figure 6:
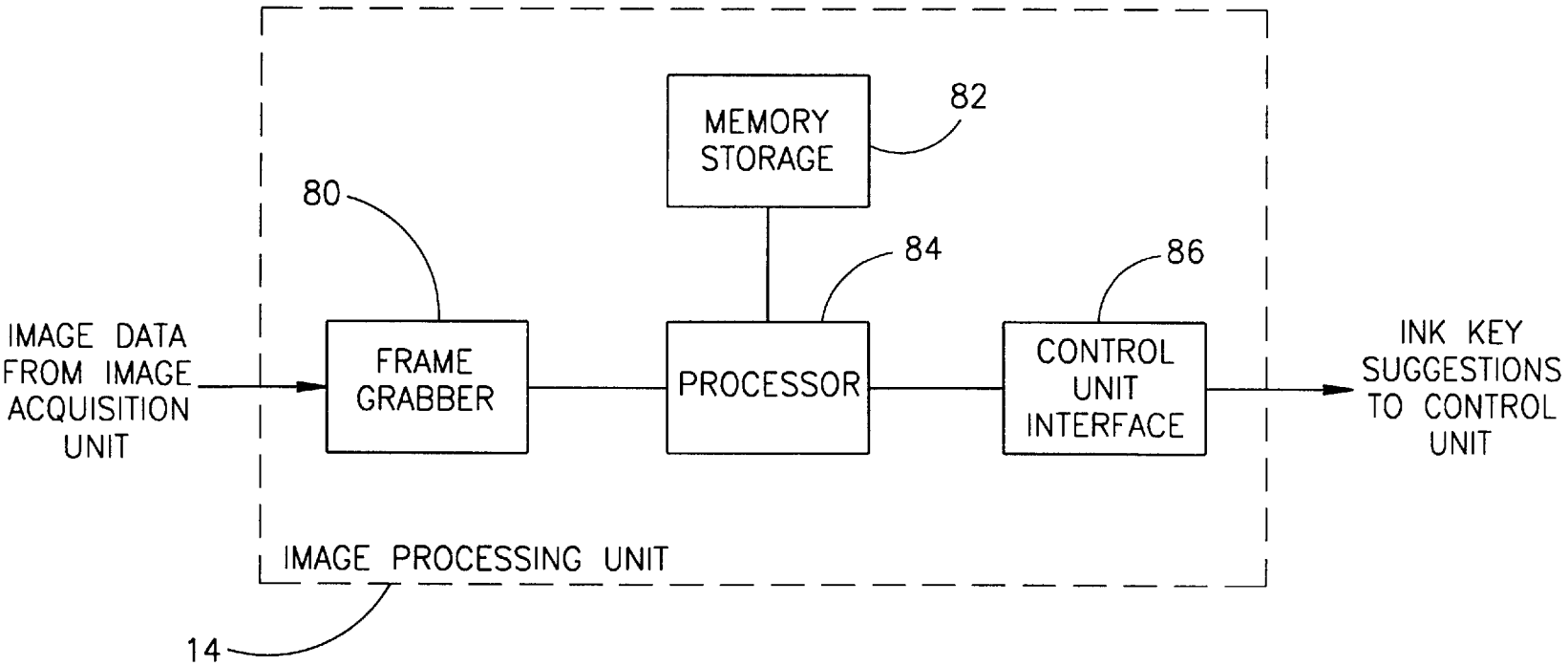
FIG. 6 is a high level block diagram illustrating the image processing unit in more detail.

The image processing unit 14 receives data from the image acquisition unit and functions to process and analyze the color data received. A high level block diagram illustrating the image processing unit in more detail is shown in FIG. 6. The image processing unit 14 comprises a color frame grabber 80, a processor 84, memory storage 82 and control unit interface 86. The color frame grabber is capable of acquiring images at very high data rates. The memory storage 82 must be capable of storing several print images simultaneously. The processor 84 must be powerful enough to run the color processing methods described below. The color processing methods of the present invention divide the print image into several strips corresponding to each ink zone or ink key of the press. Each of these strips are further divided into Regions Of Interest (ROIs). The ROIs are color patches within the image. Color control is achieved by the analysis and comparison of the global features of all the ROIs. In other words, their average properties, e.g., RGB color, are compared between the test print and the reference image. The color comparison can be performed using any color space, e.g., RGB, CMYK, CIE Lab. However, it is preferable to use the perceptual color space Lab because it closely imitates human visual perception.

Figure 7:
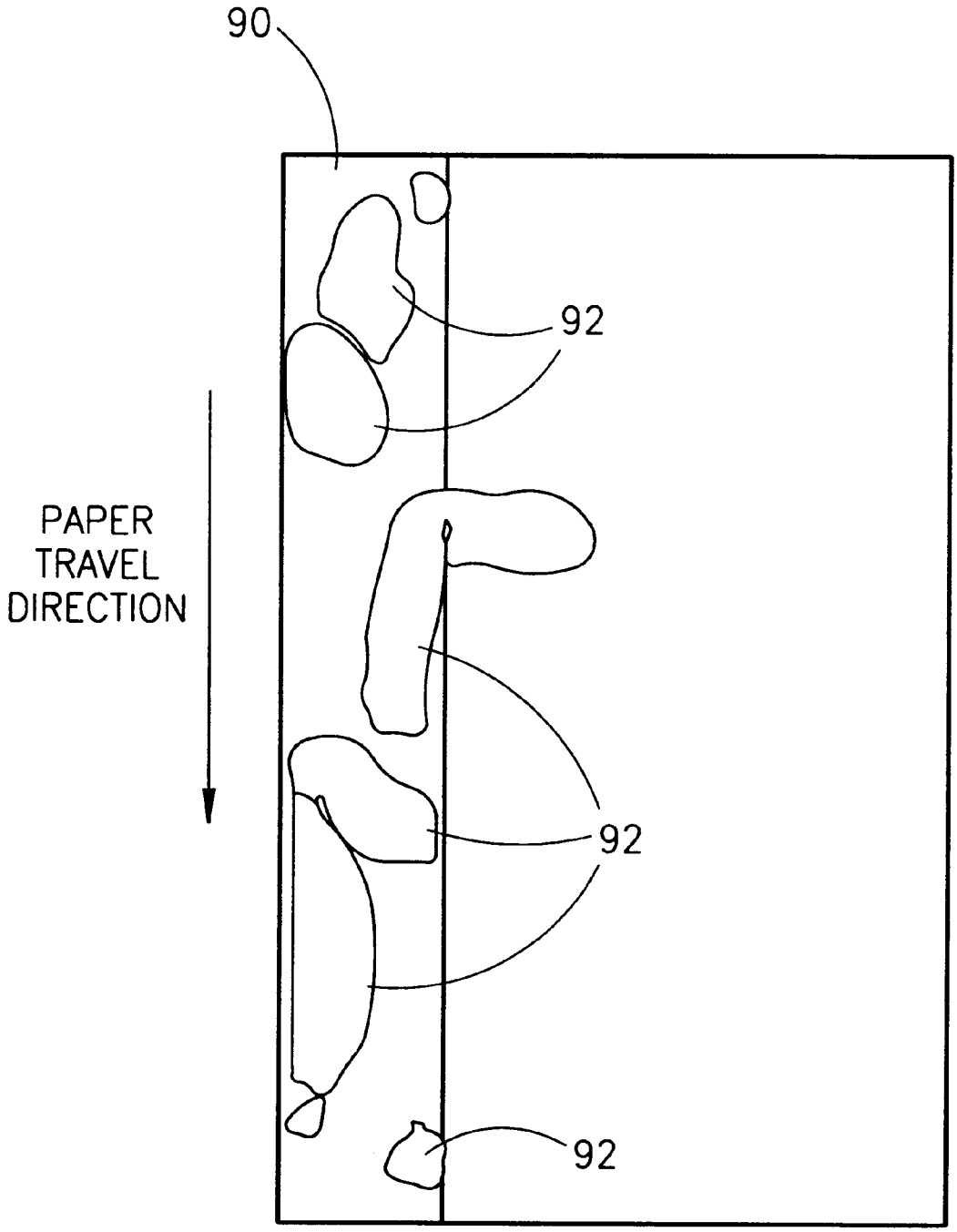
FIG. 7 illustrates the sectioning of a sample key into a plurality of regions of interest (ROIs)

An illustration of the sectioning of a sample key into a plurality of ROIs is shown in FIG. 7. Sample key 90 is shown having a plurality of ROIs 92 having various shapes and sizes. The color processing methods performed by processor 84 can be divided into two major portions. The first portion processes the reference image, i.e., the OK sheet, which is performed at the beginning of the run, after the make ready stage has been completed. The second portion of the method involves the processing of the color data from the test print image which takes place during the regular running of the printing press. The reference image processing will be described first.

Reference Image Processing

The reference image is acquired by the image acquisition unit 12 (FIG. 1). The color deviations of the normally acquired test images are measured relative to the reference image. The reference image is taken as the OK sheet, as determined by the pressman or operator. Alternatively, the reference image can be either the pre-press digital data, the plate digital data, the proof or a combination of these options along with the OK sheet. As previously described, the reference image is divided into 'ink zones' corresponding to the ink keys of the printing press. Each ink zone is further analyzed by the algorithm described below. Each ink zone is divided into N regions of interest or ROIs which function as color reference patches. The number of ROIs N is typically a large number that varies from print to print. The average properties of the ROIs are extracted and analyzed. Color change control is accomplished by comparing each ROI's average properties between the test and the reference image.

The ROIs are defined as relatively homogeneous color patches in the color CIE Lab space, i.e., the perceptual space, and they cover the print's color gamut for optimal color control. Most of the print's area is covered by a plurality of ROIs. The ROIs and their properties are extracted using a segmentation algorithm and stored in a database for use during both current and future press runs. Some of the features determined include, for example, average RGB, CMYK, Lab, color type, importance, sensitivity, etc. CMYK ink values are derived either from pre-press data or calculated during the make ready process. A binary image of each ROI mask is stored and later used to calculate the corresponding features in the test image. The ROI is a rectangular area with the binary mask defining the pixels within the rectangular area that actually comprise the ROI. This technique is used to shorten computation response time during the running of the press. Thus, each ROI comprises a location, binary mask and a set of properties or features. In addition, ROIs can be manually defined and processed by the pressman or operator.

Further, the ROI selection process rejects those ROIs that may potentially introduce noise due to variable feature properties caused by spatial displacement. Rejecting these ROIs minimizes the influence of variations in print velocity in system performance and obviates the need for external registration controls.

For any color comparison between the reference image and the test print to be meaningful requires that the two images must be aligned. The image processing unit performs the alignment. During the processing of the reference image, registration patterns are extracted and used for alignment during the running of the press. The image is divided into several large zones with each being aligned independently of each other in order to minimize the noise due to web velocity changes, acquisition displacement and other nonlinearities.

Figure 8:
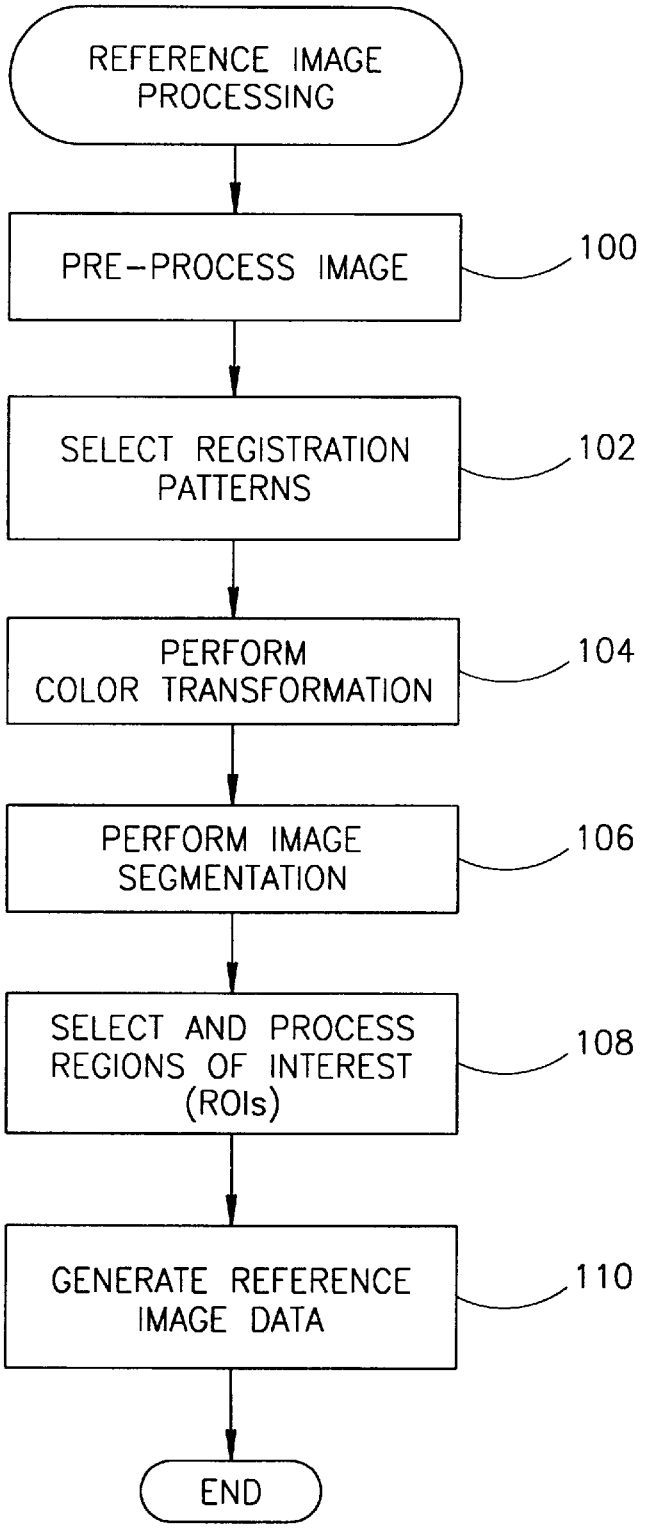
FIG. 8 is a high level flow diagram illustrating the reference image processing portion of the present invention.

A high level flow diagram illustrating the reference image processing portion of the present invention is shown in FIG. 8. First, the image is pre-processed (step 100). During this step, noise reduction is performed on the image using, for example, low pass filtering function in combination with a reference. Noise in the reference image may be due to nonlinear displacements of the image, for example. The registration patterns are then selected (step 102) automatically by searching for edges in the image that are suitable for use as registration patterns. The registration patterns are stored in the database as part of the reference image.

A color transformation is then performed on the reference image using image processing techniques well known in the art (step 104). Originally, the reference image is represented in the RGB color space as it is received from the acquisition unit. A color transformation of the reference image is performed from the RGB color space to the CIE Lab color space. The transformation is derived in accordance with a specific set of parameters. The parameters are determined during a calibration phase of operation. During the calibration phase, a colorimeter is used to measure known colors. Regression analysis techniques are then applied to the differences between the measured colors and the actual known colors. The results of the analysis are used to generate the set of parameters used in the transformation.

Image segmentation is then performed to yield the ROIs for the image (step 106). Note that the image segmentation algorithm is not limited to any one particular color space. The reference image data can be represented using any desired color space. Preferably, however, the Lab color space is used. The image segmentation algorithm is described in more detail below. Then, the regions of interest (ROIs) are processed (step 108). The ROIs are listed and their properties are generated. The ROI properties that are generated include those described previously. Finally, the reference image data is generated (step 110).

Figure 9:
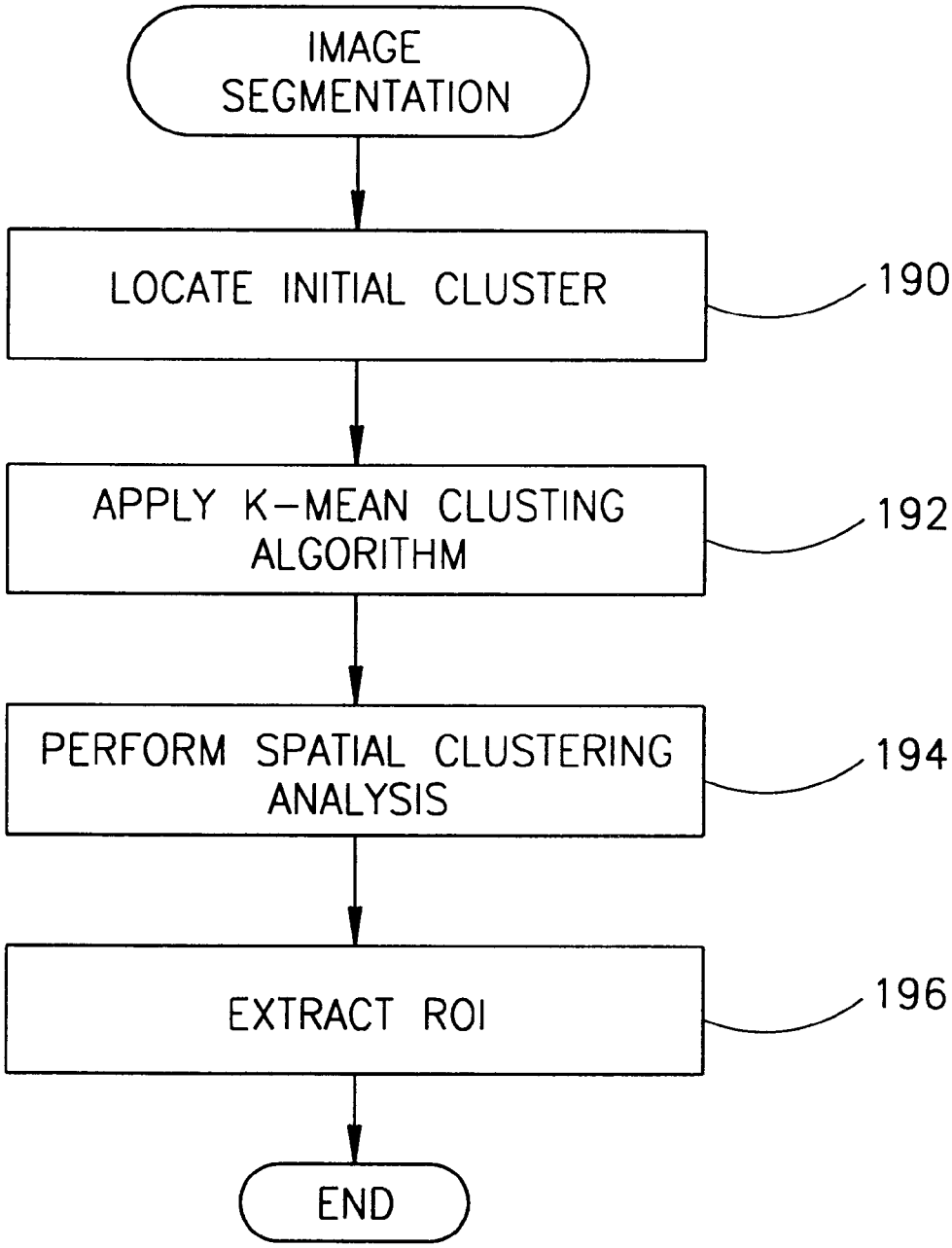
FIG. 9 is a high level flow diagram illustrating the image segmentation processing portion of the present invention.

The image segmentation algorithm will now be described in more detail. A high level flow diagram illustrating the image segmentation processing portion of the present invention is shown in FIG. 9. The function of the image segmentation algorithm is to divide the image into regions of constant color, as perceived by the human visual system. Segmentation is accomplished by using a clustering algorithm that divides the spectral RGB image into regions containing pixels having the same color in the Lab color space.

The clustering algorithm used in a modified K-mean clustering algorithm, well known in the image processing art. The operation of the K-mean clustering algorithm does not require any prior information or user input and is completely automatic. However, modifications can be made by a user if desired.

The clustering algorithm chooses an initial trial cluster center arbitrarily (step 190). The K-mean clustering algorithm is then run iteratively, increasing the number of clusters in the image until all pixels are classified (step 192).

The next step is to perform spatial clustering which comprises the grouping of proximate pixels belonging to the same cluster into preliminary ROIs (step 194). A standard labeling algorithm, well known in the art, is used to perform this step. At the end of this process, the final ROIs are extracted with restrictions imposed on size, location and color (step 196). It is important to note that the ROIs selected cover the entire print gamut and are distributed over the entire image. A binary mask, defining all the pixels belonging to the specific ROI, is then derived and stored as part of the reference ROI. In addition, the ROI information extracted is immune to spatial displacement. This is accomplished by applying a nonlinear morphological algorithm, e.g., an open operator, to the mask that is extracted for each ROI. This is described in more detail in the text Digital Image Processing, W. K. Pratt, page 487.

Test Image Processing

The test image processing will now be described in more detail. The test image processing for effecting color control utilizes an optimization process based on the analysis of a plurality of ROIs all of which arc located in the same ink key zone. The processing performed by the image processing unit of the present invention resolves the ambiguity which is inherent in the transformation from the three stimulus RGB image, generated by the image acquisition unit, to the CMYK ink variables of the printing press, required in order to determine the ink key adjustments. More specifically, the transformation cannot distinguish between the black ink and the three process color inks, CMY, there being an infinite number of combinations of CMYK that can produce the same color in RGB space. The test image processing solves this ambiguity by analyzing a plurality of ROIs rather than just one. Since all ROIs within an ink key zone are subject to the same changes in the inking process, they all must be corrected using the same ink key adjustment. The ambiguity is resolved using an optimization process, described below, that chooses one CMYK change for each ink key zone such that the sum of all color deviations, for all ROIs, following the ink key adjustment, will be minimized with respect to the reference image in the Lab color space.

Optimization is performed based on measurements from all ROIs utilizing a priori information in the form of a weight for each ROI, e.g., color sensitivity, type of color, user defined importance, etc. In addition, information obtained on the fly as to how much the color of the specific ROI has been changed is used. The operator is given the ability to process the ROIs, define new ROIs, set ROI weights and control the tolerance for the entire system.

A high-level flow diagram illustrating the test processing portion of the present invention is shown in FIG. 10. The color monitoring performed during the running of the press is based on the comparison and analysis of the average properties of ROIs between the test and the reference image. First, the test image is acquired by the image acquisition unit (step 120). Next, the test image is aligned with the reference image acquired previously (step 122). The alignment procedure is necessary in order to obtain a meaningful comparison of ROI properties between the test and reference images since they were acquired at difference times. Alignment of the images is performed using a normalized gray scale cross correlation, as described in the text Digital Image Processing, W. K. Pratt, pages 662–671, incorporated herein by reference. The selected registration patterns previously derived from the reference image are utilized in the alignment process. The locations of the registration patterns in the test image are determined relative to their location in the reference image and arc used as the offset for the spatial registration process. Note that the alignment is performed in real time on each acquired test image.

Following alignment of the test image, the test image is divided into a plurality of ink zones in accordance with the actual ink zones used in the press machine (step 124). Each ink zone is subsequently processed independently of all other ink zones using the method described herein.

Assume that within each ink zone there are N ROIs, each containing Q pixels. The average R, G, B of each ROI in the RGB color space is then calculated (step 126). The average can be expressed for each ROI as follows $$\mathrm{AVG}(CT_i) = \frac{1}{Q_i}\sum_{j=0}^{Q_i} CT_{ij}$$

where CT represents the RGB color vector (r, g, b) for pixels in the test image and i represents ROI i and ranges from i=0 to N.

Color comparison is performed in the Lab color space and measured in units of ΔE. The average RGB of each ROI is then transformed into the Lab color space using transformation T1 which represents the color transformation from the RGB color space to the Lab color space (step 128). As described above, the transformation T1 was previously derived during the calibration stage and can be expressed as $$DT_i = T1\{AVG(CT_i)\}$$

for each ROI i where DT represents the Lab color vector (L, a, b). The difference ΔE for each ROI i can be expressed as $$\Delta E_i = \sqrt{(DT_i - DR_i)^2} = \sqrt{(L_T - L_R)^2 + (a_T - a_R)^2 + (b_T - b_R)^2}$$

where $DT_i$ and $DR_i$ represent the average color vectors transformed into the Lab color space for the test and reference ROI i, respectively (step 130). The subscripts T and R represent the test and reference images, respectively.

The $\Delta E_i$ of each ROI is then compared to a predetermined threshold which is modifiable and under user control (step 132). If every ΔE, is smaller than the threshold, it means no substantial color change occurred in the particular ink zone. Thus, the ink zone does not require processing. The method then continues with step 124 and the next ink zone is examined. Otherwise, an optimization algorithm is then applied to determine the appropriate change in CMYK, expressed as ΔCMYK, needed to restore the color back to its reference value.

Since ROIs of different colors may respond in different ways to the same ink changes, the color change for an ink zone must be determined statistically. The statistical determination is based on the measurements taken over all the ROIs in the ink key, thus providing an a priori weight for each ROI. The weight includes such factors as the $\Delta E_i$ of the ROI and the importance and sensitivity of the ROI as determined during the reference image processing.

Moreover, the CMYK ink key changes determined for a ROI is not unique due to the metamerism property of colors which states that many CMYK combinations yield identical RGB or Lab colors. The test image processing of the present invention utilizes the measurements from a plurality of ROIs, all within a single ink zone and subject to the same ink variation, to resolve this ambiguity.

The method simulates several black ink changes that possibly may have caused the observed color change (step 134). The term $KR_i$ is used to represent the black value of ROI i of the reference image. The simulated black ink changes are denoted by Aj where j ranges from 0 to M. The values Aj and M are adaptively defined during run time. The change in the black ink Aj for an ink zone is translated into the actual ink key change δKj by a function F that reflects the press' properties and is derived for each press type individually as represented in the equation below. The function F can be approximated by a polynomial $$\delta K_j = F(KR_i) = \sum_{\alpha=0}^{2} A_{\alpha j}\cdot KR_i^2 = A_{0j} + A_{1j}\cdot KR_i + A_{2j}\cdot KR_i^2$$

The new black value KN based on the simulated changes to the black ink for ROI i is given by $$KN_{ij} = KR_i + \delta K_j$$

Once the new simulated KN value of the $i^{th}$ ROI is calculated, its new CMYK value can then be determined using the RGB (or Lab) to CMYK transformation T2, also derived during the calibration stage of the system (step 136). For each ROI i and simulated change j $$CMYKi_j = T2(RGB_i, KN_{ij}) = \Delta E_i \cdot U_i$$

Where $U_i$ is the normalized importance given to $ROI_i$ by the user.

Following the transformation stage, the new simulated $CMYK_{ij}$ values of all ROIs within the same ink zone have been obtained. It is these $CMYK_{ij}$ values that we want to bring back to the original $CMYK_i$ values in the reference image. Since the transformation from $CMYK_{ij}$ to $CMYK_i$ of the reference image cannot be expressed analytically, a regression technique is utilized to find the optimum transformation between the two variable sets (step 138).

The new value for each of the C, M, Y, K is expressed as a linear combination of the simulated C, M, Y. K, respectively. For example, the new value of the cyan color, denoted C, for each ROI i can be expressed as $$C_i = \sum_{p=0}^{2} B_{ip} C_i^p$$

where $B_{ip}$ are the coefficients.

Note that depending on the accuracy of the system, a more complicated model can be used that takes into account the cross dependence between the cyan, magenta and yellow color variables.

The coefficients $B_{ip}$ are calculated using the least square approximation method. Thus, the following equation is minimized to find the coefficients $$\mathrm{MIN}\left(\sum_{i=0}^{N}\left[CR_i - \sum_{p=0}^{2}(W_i B_{ip} C_i^p)\right]^2\right)$$

where $CR_i$ represents the cyan color value for $ROI_i$ and $W_i$ denotes the weight given to $ROI_i$. The weight $W_i$ is given by $$W_i = f(\Delta E_i, U_i)$$
$$= \Delta E_i \cdot U_i$$

where $U_i$ is the normalized importance given $ROI_i$ by the user.

Alternatively, the equation given above for the minimum can be solved using $$\frac{\partial}{\partial B}\left\{\sum_{i=0}^{N}\left[MR_i - \sum_{p=0}^{2} B_{ip} M_i^p\right]^2\right\} = 0$$

Which leads to a set of linear equations. Solving the set of linear equations yields the values of the transformation matrix $B_{ip}$. The procedure is repeated for the magenta and yellow color variables as well, as denoted as transformation $T3_j$. Applying the transformation $T3_j$ yields $$CMYK'_{ij}=T3_j(CMYK_{ij})$$

which gives us the new simulated $CMYK'_{ij}$ values for ROI i and simulated change j (step 140).

The new $CMYK'_{ij}$ value for the simulated change δKj can be derived in an alternative way. Let Δ(CMYKij)=CMYKij−CMYKi be the difference between ROI's CMYK value and its desired reference value. The difference, Δ(CMYKij), of each ROI is next translated into ink key changes by applying a function G which translates ROI's actual change into ink change δ(CMYK). The function G is the inverse function to F which was applied above and reflects the physical properties of the printing process and the press machine. This function is derived during system calibration stage. The term aij is used to represent the vector (CMYK). Applying the transformation G we get:

$$\delta aij=G(\Delta aij).$$

δaij is the ink key change required to restore ROI's i values back to its reference values. An optimization algorithm O is used to derive the best ink change Ai for the entire zone:

$$Aj=O\ (\delta aij, \Delta Ei, Wi)$$

where δEi is the Lab color difference for ROI i, Wi is a normalized weight. The calculated ink change for the zone is then used to calculate the new simulated CMYK values of all zone's ROIs as was in the previous method, transformation T3j.

$$CMYK'ij=G(CMYKij, Aj)$$

For either of the methods used, applying the inverse transform T4 from CMYK color space to Lab color space yields the new Lab color value for the ROI i of simulation j, i.e., Lab'=(L', a', b') (step 142). The inverse transform T4 from CMYK color space to Lab color space is derived during the calibration stage of the system. The transformation T4 can be expressed as $$Lab'_{ij}=T4(CMYK'_{ij})$$

The difference between the transformed Lab' color and the required reference Lab color is calculated as a Euclidean distance in the Lab color space (step 144). For each ROI i $$\Delta E'_{ij} = \sqrt{(L'_{ij} - L_{Ri})^2 + (a'_{ij} - a_{Ri})^2 + (b'_{ij} - b_{Ri})^2}$$

where the subscript R denotes reference image values. The above described simulation is performed for all simulated values $\delta K_j$ for j=0 to M. The simulated change that optimally restores the color to the ROI is chosen for the ink key change (step 148). This is determined in accordance with the following $$ti\ MIN_{j=0}^{M}\{MAX_{i=0}^{N}(\Delta E'_{ij})\cdot w+[Z(\Delta E'_{ij})+\sigma(\Delta E'_{ij})]\cdot(1-w)\}$$

where w=an experimentally determined weight

Z=mean or average

σ=standard deviation

The simulated change j that yields the optimum restoration to the reference values is chosen. The CMYK change to be applied to the ink zone is then calculated (step 150). Transformation T3j is applied for mid-tone values, the results then translated into ink key values in accordance with a calibration table calculated a priori. Note that the image processing unit 14 (FIG. 1) outputs the simulated changes to the control unit 16. The actual ink key values are calculated in the control unit which is also responsible for maintaining the calibration table.

In addition to acquiring the image through the frame grabber, storing the image in the memory storage unit 82 and performing test image processing, the image processing unit functions to inspect the print and detect various printing defects, e.g., distortions, scratches, etc. that may have been caused due to plate damage, dirt and other causes that deteriorate print quality. The system functions to alert the user or pressman of any defects detected. In addition, the system will mark the respective prints with an indication that a defect was found. Further, the system also functions to perform color to color registration thus obviating the need for extra registration add-on systems. The system can also function to shorten the make ready stage by utilizing pre-press digital data for automatic ink pre-setting.

Control Unit

The control unit 16 (FIG. 1) of the color control system 10 will now be described in more detail. The control unit is responsible for the synchronized operation of the color control system in addition to providing the interface to the printing press itself. The speed of the press is continuously measured during the printing process via a shaft encoder 180 (FIG. 2) located on the press machine. Alternatively, a tachometer can be used. Synchronization means functions to synchronize the image grabbing operation and perform adjustment of other system parameters, e.g., illumination, shutter, etc., for the press so the system will function independently of the press' speed. The control unit also provides an interface to the ink keys and/or control table of the press for controlling the ink and water keys in accordance with the suggestions received from the image processing unit. Since the control unit is used to interface to the ink keys of the printing press it functions to decouple the operation of the image processing unit from the particular printing press machine used and further enables the use of identical image processing units for a wide variety of presses. A customized interface to the ink keys for interfacing with different printing press machines is required only for the control unit. Similarly, only the control unit need be adapted to handle system adjustments for operation with different paper and ink types. Thus, the control unit is responsible for the control of the ink keys and other machine controls on the printing press in accordance with the CMYK suggestions generated by the image processing unit.

The actual ink key change is calculated using the suggestions provided by the image processing unit and the information about the specific press. A closed loop control algorithm is used to monitor the ink key changes actually applied. The change is calculated utilizing trend analysis, i.e., averaging past changes, and a press time response function derived during the calibration stages.

Console Unit

The console unit 18 (FIG. 1) will now be described in more detail. The console unit functions to provide the main control for the color control system 10. It controls, for example, the starting, stopping and mode of operation of the system. In addition, it displays the status of the system and provides the user interface to the operator or pressman.

During the pre-running stage of operation of the press, the console unit allows the operator to select and define new ROIs, change the properties of the ROIs selected by the image processing unit, e.g., delete or change priority of an ROI, and monitor the color changes of any individual test patch ROI in the image. In addition the operator has the ability to adjust the color control tolerances for the entire system and the individual ROIs as well, thus being able to control the feedback operation of the system.

During the running phase of the printing press, the image processing unit transmits to the console unit the image of the acquired print along with information regarding the color quality of the printing process, e.g., color changes and trends, ink key status, color corrections applied, statistical reports, etc. Displaying the print image on the display screen provides the press operator with a web viewing capability. During press run time, the console unit displays this information on a display screen (not shown) for the user, i.e., operator or pressman. The console unit also functions to alarm the operator of any colors that cannot be adjusted in addition to any abnormal fluctuations that may have occurred during the press run.

At the end of the printing process, the system provides the operator detailed statistical information regarding the quality of the print color for the press run. This data is also stored in the memory storage 82 (FIG. 6) thus providing archiving facilities for the plant the system is located in.

While the invention has been described with respect to a limited number of embodiments, it will be appreciated that many variations, modifications and other applications of the invention may be made.

What is claimed is:

1. A color control system for maintaining the color of a printed page of a printing press constant, within the context of the human perceptual color space, said system optimizing the settings of a plurality of ink keys in a printing press in accordance with a test image and a reference image, said test image and said reference image comprising a plurality of ink key zones corresponding to said plurality of ink keys, each ink key zone comprising a plurality of regions of interest (ROIs), said system comprising:

means for acquiring an image of said printed page, wherein said image is acquired in the sensor domain, said means for acquiring operative to acquire said test image and said reference image;

means for converting said test image from the sensor domain to the human perceptual color space;

means for dividing said reference image into a plurality of ROIs, each ROI being a substantially homogenous color patch in the human perceptual color space and having arbitrary shape;

means for calculating a first color vector in the sensor domain for each ROI in said test image and for converting said first color vector to a second color vector in the human perceptual color space;

means for analyzing the differences between colors in the human perceptual color space of said plurality of ROIs of said test and said reference images;

means for determining the impact on CMYK values in accordance with the output of said means for analyzing the differences and for generating a set of CMYK changes in response thereto; and means for applying said set of CMYK changes to said plurality of ink keys.

2. The color control system according to claim 1, wherein said means for acquiring an image comprises means for imaging the entire area of the printed page in generating said reference image and said test image.

3. The color control system according to claim 1, wherein said means for analyzing the differences utilizes information in the form of a weight and a sensitivity for each ROI.

4. A method of maintaining the color of a printed page of a printing press constant within the context of the human perceptual color space with respect to a reference image, said printed page including a plurality of ink key zones, said method comprising the steps of:

acquiring a test image of the entire printed page, wherein said test image is acquired in the sensor domain;

converting said test image from the sensor domain to the human perceptual color space;

dividing said reference image into a plurality of Regions of Interest (ROIs), each ROI being a substantially homogenous color patch in the human perceptual color space and having arbitrary shape;

assigning a weight and a sensitivity to each ROI; calculating a first color vector in the sensor domain for each ROI in said test image and for converting said first color vector to a second color vector in the human perceptual color space;

analyzing the difference between colors in the human perceptual color space of space plurality of ROIs in said test and said reference images;

determining the impact on CMYK values in accordance with the analysis of the differences and generating a set of CMYK changes in according thereto; and applying said set of CMYK changes to said plurality of ink keys.

5. A method for maintaining the color of a printed page of a printing press constant, within the context of the human perceptual color space, said method optimizing the setting of a plurality of ink keys in a printing press in accordance with a test image and a reference image, said test image and said reference image comprising a plurality of ink key zones, each ink key zone comprising a plurality if regions of interest (ROIs), said method comprising the steps of:

acquiring a test image of the entire printed page, wherein said test image is acquired in the sensor domain;

converting said test image from the sensor domain to the human perceptual color space;

dividing said reference image into a plurality of Regions of Interest (ROIs), each ROI being a substantially homogenous color patch in the human perceptual color space and having arbitrary shape;

calculating a first color vector in the sensor domain for each ROI in said test image and for converting said first color vector to a second color vector in the human perceptual color space;

analyzing the difference between colors in the human perceptual color space of said plurality of ROIs in said test and said reference images so as to generate a set of CMYK values, one for each ink key zone, such that the sum of color deviations following ink key changes for all ROIs, relative to said reference image, is minimized in the human perception color space, and applying said set of CMYK changes to said plurality of ink keys.

6. The method according to claim 5, wherein said step of dividing comprises the step of applying a weight and a sensitivity to each ROI.

7. In a color control system for maintaining optimal settings for a plurality of ink keys in a printing press in accordance with a test image and a reference image, said test image and said reference image comprising a plurality of regions of interest (ROIs), a method for processing said test image, said method comprising the steps of:

dividing said test image into a plurality of ink zones;

calculating the average RGB of each ROI in said ink zone, wherein each ROI being a substantially homogenous color patch in the human perceptual color space and having arbitrary shape;

transforming said average RGB of each ROI into the human perceptual color space;

calculating the color difference ΔE between the test and reference ROIs;

comparing the color difference of each ROI to a predetermined threshold whereby said ink zone is not affected if said color difference is below said threshold and processing continues with the next ink zone in said plurality of ink zones;

selecting a new black value for each ROI in said ink zone;

calculating a simulated CMYK value for said ROI;

determining a first optimum transformation between said new CMYK value and a CMYK value of said reference image;

transforming said simulated CMYK values to the human perceptual color space;

calculating the color difference between said simulated and said reference values for said ROI;

determining a second optimum transformation that best restores the color of said ROI to that of said ROI within said reference image; and calculating the change in CMYK for said ink zone utilizing said second optimum transformation.

8. The method according to claim 7, further comprising the step of transforming said change in CMYK value into new ink key values in accordance with a calibration table.

9. In a color control system for maintaining optimal settings for a plurality of ink keys in a printing press in accordance with a test image and a reference image, said test image and said reference image comprising a plurality of ink zones corresponding to said plurality of ink keys, each ink zone comprising a plurality of regions of interest (ROIs), a method for processing said test image, said method comprising the steps of:

acquiring a test image of the entire printed page, wherein said test image is acquired in the sensor domain;

converting said test image from the sensor domain to the human perceptual color space;

dividing said reference image into a plurality of ROIs, each ROI being a substantially homogenous color match in the human perceptual color space and having arbitrary shape;

calculating a first color vector in the sensor domain for each ROI in said test image and for converting said first color vector to a second color vector in the human perceptual color space;

analyzing the difference between colors in the-human perceptual color space of said plurality of ROIs in said test and said reference images so as to generate a set of CMYK values, one for each ink key zone, such that the sum of color deviations following ink key changes for all ROIs, relative to said reference image, is minimized in the human perception color space; and analyzing the difference of said plurality of regions of interest (ROIs) within said ink zone said test image and said reference image; and choosing one CMYK change for said ink zone such that the sum of all color deviations, for said plurality of ROIs, following adjustment of the ink key corresponding to said ink zone, is minimized with respect to said reference image.

10. The method according to claim 9, wherein said step of analyzing is based on measurements from said plurality of ROIs, said measurements taking the form of a weight and a sensitivity for each ROI.

11. A color control system for maintaining for a plurality of ink keys in a printing press in accordance with a reference image, said system comprising:

an image acquisition unit for acquiring a test image of a print printed on said printing press, wherein said image is acquired in the sensor domain;

an image processing unit coupled to said image acquisition unit, said image processing unit for converting said test image from the sensor domain to the human perceptual color space dividing said reference image into a plurality of ROIs each ROI being a substantially homogeneous color patch in the human perceptual color space and having arbitrary shape, calculating a first color vector in the sensor domain for each ROI in said test image and for converting said first color vector to a second color vector in the human perceptual color space, analyzing the differences between colors in the human perceptual color space of said plurality of ROIs of said test and said reference images, determining the impact on CMYK values in accordance with the analysis of the differences, said image processing unit for generating at least one color correction suggestion for use in adjusting said plurality of ink keys;

a control unit coupled to said image processing unit, said control unit for controlling said plurality of ink keys on said printing press in accordance with said at least one suggestion; and a console unit coupled to said image acquisition unit, said image processing unit and said control unit, said console unit for providing, through a user interface, control over said system, status information and information about the color quality of the printing process.

12. The color control system according to claim 11, wherein said image processing unit comprises:

a processor for controlling said image processing unit and for executing analysis procedures on said reference and said test images;

a frame grabber for receiving image data from said image acquisition unit, said frame grabber for generating and transmitting to said processor a digital representation of said imaging strip;

a memory storage unit coupled to said processor, said memory unit for storing print images; and a control unit interface coupled to said processor, said control unit interface for providing an interface between said image processing unit and said control unit.

13. The color control system according to claim 11, wherein said image acquisition unit comprises:

illumination means for illuminating a strip of said print;

camera means for receiving light from said strip of said print, said camera means comprising three spectral channels; and optical means for directing light from said strip to each of said three spectral channels.

14. The color control system according to claim 13, wherein said illumination means comprises at least one lamp element.

15. The color control system according to claim 14, wherein said at least one lamp element comprises an aperture fluorescent lamp.

16. The color control system according to claim 13, wherein said camera means comprises charge coupled device (CCD) sensors.

17. The color control system according to claim 13, wherein said camera means comprises tri-linear color time delay integration (TDI) charge coupled device (CCD) sensors.

18. The color control system according to claim 13, wherein said optical means comprises a plurality of tilted mirrors placed in the optical path defined between said strip and said camera means such that said three spectral channels image said strip.

* * * * *